US011116382B2

(12) United States Patent
Han et al.

(10) Patent No.: US 11,116,382 B2
(45) Date of Patent: Sep. 14, 2021

(54) SLIDING STRUCTURE, BASKET AND DISH WASHER

(71) Applicant: FOSHAN SHUNDE MIDEA WASHING APPLIANCES MANUFACTURING CO., LTD., Guangdong (CN)

(72) Inventors: Jiawei Han, Guangdong (CN); Zhentao Zhong, Guangdong (CN)

(73) Assignee: FOSHAN SHUNDE MIDEA WASHING APPLIANCES MANUFACTURING CO., LTD., Guangdong (CN)

( * ) Notice: Subject to any disclaimer, the term of this patent is extended or adjusted under 35 U.S.C. 154(b) by 0 days.

(21) Appl. No.: 16/838,135

(22) Filed: Apr. 2, 2020

(65) Prior Publication Data

US 2020/0229675 A1 Jul. 23, 2020

Related U.S. Application Data

(63) Continuation of application No. PCT/CN2018/123152, filed on Dec. 24, 2018.

(51) Int. Cl.
*A47L 15/50* (2006.01)
*A47B 88/427* (2017.01)
(Continued)

(52) U.S. Cl.
CPC ..... *A47L 15/507* (2013.01); *A47B 88/427* (2017.01); *A47B 88/483* (2017.01);
(Continued)

(58) Field of Classification Search
CPC ..... A47L 15/507; A47L 88/483; A47L 88/49; A47L 88/477; A47L 88/433;
(Continued)

(56) References Cited

U.S. PATENT DOCUMENTS 5,671,986 A * 9/1997 Vinet ..... A47L 15/507 312/311
6,145,944 A * 11/2000 Bayani ..... A47B 88/493 312/334.11

(Continued)

FOREIGN PATENT DOCUMENTS

CN 201948400 U 8/2011
CN 203041354 U 7/2013

(Continued)

OTHER PUBLICATIONS

International Search Report dated Sep. 30, 2019 received in International Application No. PCT/CN2018/123152 together with an English language translation.

(Continued)

*Primary Examiner* — Hanh V Tran
(74) *Attorney, Agent, or Firm* — Scully, Scott, Murphy & Presser, P.C.

(57) ABSTRACT

The present disclosure provides a sliding structure, a basket and a dish washer. The sliding structure is configured to enable the basket to move. The sliding structure has a connecting member connected to the basket. The sliding structure also has at least one support member connected to the connecting member. The support member has an engaging groove and an accommodating groove spaced from the engaging groove. One end of the connecting member is engaged in the engaging groove. The sliding structure further has a guiding rail connected to the support member and received in the accommodating groove.

17 Claims, 6 Drawing Sheets

(51) Int. Cl.
*A47B 88/483* (2017.01)
*A47B 88/40* (2017.01)

(52) U.S. Cl.
CPC . *A47B 2088/401* (2017.01); *A47B 2088/4278* (2017.01); *A47B 2210/0024* (2013.01); *A47B 2210/0059* (2013.01); *A47B 2210/04* (2013.01); *A47B 2210/05* (2013.01); *A47B 2210/17* (2013.01)

(58) Field of Classification Search
CPC ..... A47L 88/427; A47B 2088/4278; A47B 2088/401; A47B 2210/0024; A47B 2210/04; A47B 2210/05; A47B 2210/0059; A47B 2210/17
See application file for complete search history.

(56) References Cited

U.S. PATENT DOCUMENTS 6,491,173 B1 * 12/2002 Costa ..... A47B 88/427 211/126.15
7,455,066 B2 * 11/2008 Feddema ..... A47L 15/502 134/56 D
8,210,371 B2 * 7/2012 Kim ..... F25D 25/022 211/126.15
9,596,931 B1 * 3/2017 Nimgulkar ..... B65D 7/20
10,595,707 B2 * 3/2020 Singhal ..... A47B 88/493
10,602,910 B2 * 3/2020 Gutkowski ..... A47L 15/504
2006/0250058 A1 * 11/2006 Stevens ..... A47L 15/502 312/311
2008/0054772 A1 * 3/2008 Koloff ..... F25D 25/024 312/404
2009/0050186 A1 * 2/2009 Kim ..... A47L 15/507 134/165
2009/0096338 A1 * 4/2009 Jahrling ..... A47L 15/504 312/334.5
2010/0019637 A1 * 1/2010 Guttinger ..... A47B 88/493 312/334.5
2010/0218755 A1 * 9/2010 Stewart ..... A47L 15/507 126/339
2011/0114138 A1 * 5/2011 Bastuji ..... A47L 15/507 134/135
2015/0190033 A1 * 7/2015 Shaffer ..... A47L 15/507 312/228.1
2015/0305493 A1 * 10/2015 Garcia ..... A47B 46/005 211/86.01
2016/0270532 A1 * 9/2016 Gleixner ..... A47L 15/502
2016/0331204 A1 * 11/2016 Kutto ..... A47L 15/504
2016/0377223 A1 * 12/2016 Heffel ..... F16B 12/38 248/215
2017/0143118 A1 * 5/2017 Azkue ..... A47L 15/504
2017/0181538 A1 * 6/2017 Azkue ..... F24C 15/168
2017/0343024 A1 * 11/2017 Chiang ..... A47B 67/04
2018/0140166 A1 * 5/2018 Meier ..... A47L 15/507
2018/0172340 A1 * 6/2018 Cizik ..... F25D 25/025
2018/0184807 A1 * 7/2018 Min ..... A47B 88/493
2018/0313545 A1 * 11/2018 Jeong ..... A47B 88/427
2020/0015654 A1 * 1/2020 Buesing ..... B29C 45/0025
2020/0046199 A1 * 2/2020 Busing ..... A47L 15/507

FOREIGN PATENT DOCUMENTS

CN 204765177 U 11/2015
CN 205947488 U 2/2017
CN 108606757 A 10/2018
DE 20006242 U1 6/2000
EP 1 788 313 A2 5/2007

OTHER PUBLICATIONS

Written Opinion dated Sep. 30, 2019 received in International Application No. PCT/CN2018/123152 together with an English language translation.
European Search Report dated Aug. 25, 2020 received in European Patent Application No. EP 18933736.3.

* cited by examiner

SLIDING STRUCTURE, BASKET AND DISH WASHER

CROSS-REFERENCE TO RELATED APPLICATIONS

This application is a continuation application of PCT International Application No. PCT/CN2018/123152, filed on Dec. 24, 2018. The content of PCT International Application No. PCT/CN2018/123152 is incorporated by reference herein for all purposes. No new matter has been introduced.

FIELD

The present disclosure relates to the technical field of dish washers, and more particularly relates to a sliding structure, a basket including the sliding structure, and a dish washer including the basket.

BACKGROUND

In the related art, a dish washer has a basket, two support members arranged on two sides of the basket respectively, and two guiding rails. Each of the two support members is movably arranged on one corresponding guiding rail to enable or actuate the basket to move on the guiding rail. The support member includes at least two opposite rollers which are movably arranged at two sides of the guiding rail respectively. During the process of pushing and pulling the basket, the rollers roll on the guiding rails, which may generates a large noise. Further, the rollers are prone to shaking when sliding on the guiding rails, as the rollers contact the guiding rails in a point-line contact mode. In this way, the forces of the rollers on the guiding rails are imbalanced, which causes the dish washer to exhibit poor stability and load-bearing capacity.

During a mounting process of the dish washer, the basket is connected to the support members first, and then the guiding rails are respectively fixed to carrying rails on sides of the washing chamber. One end of each guiding rail is inserted between at least two oppositely disposed rollers of the support member. At this time, the rollers are driven to roll on the guiding rails by pushing the basket, so that the basket moves into the dish washer. When there is a need to disassemble the dish washer, the rollers are led to roll on the guiding rails through pulling the basket outwardly, until the basket and the support members are out of the end of the guiding rails. Obviously, the processes of mounting and disassembling the dish washer are complicated.

SUMMARY

According to an exemplary aspect of the present disclosure, a sliding structure is provided, which is capable of enabling the dish washer including the sliding structure to have the advantages of noiselessness, good stability, high bearing capacity, and easy assembly and disassembly.

For example, the sliding structure provided by the present disclosure is configured to enable a basket to move. The sliding structure includes a connecting member connected to the basket. The sliding structure further includes at least one support member connected to the connecting member. The support member includes an engaging groove and an accommodating groove spaced from the engaging groove. One end of the connecting member is engaged in the engaging groove. A guiding rail is connected to the support member and received in the accommodating groove.

Furthermore, the connecting member includes a connecting rod connected to the basket. The connecting member further includes at least one bending section engaged in the engaging groove and connected to an end of the connecting rod. An angle is defined between the bending section and the end of the connecting rod.

Furthermore, the at least one bending section includes two bending sections. The two bending sections are connected to two ends of the connecting rod, respectively. The at least one support member includes two support members. Each of the two bending sections is engaged in one corresponding engaging groove. One end of the guiding rail is received in one of the two accommodating grooves, and the other end of the guiding rail is received in the other one of the two accommodating grooves.

Furthermore, the connecting member further includes at least one abutting section connected to a free end of the at least one bending section. An angle is defined between the abutting section and the bending section, and the abutting section is configured to abut against an outer surface of the engaging groove.

Furthermore, the engaging groove includes two opposite side walls and at least one accommodating space. The side wall is configured to recess outwardly to form the accommodating space, and the bending section is received in the accommodating space. The sliding structure further includes an engaging block, the engaging block being received in the engaging groove and abutting against the bending section.

Furthermore, the at least one accommodating space includes two opposite accommodating spaces. Each of the two side walls is configured to recess outwardly to form one corresponding accommodating space. The engaging block includes a first engaging part, the first engaging part being engaged in the corresponding accommodation space.

Furthermore, the side wall adjacent to the engaging block includes a clamping groove. The engaging block further includes a second engaging part connected to the first engaging part. An angle is formed between the first engaging part and the second engaging part, and the second engaging part includes a first protrusion received in the clamping groove.

Furthermore, the clamping block further includes a third engaging part opposite to the second engaging part. The second engaging part is connected to one end of the first engaging part. The third engaging part is connected to the other end of the first engaging part. The third engaging part is configured to abut against the bending section.

Furthermore, an end of the third engaging part connected to the first engaging part is provided with a second protrusion. A bottom wall of the engaging groove includes a groove. The second protrusion is received in the groove.

Furthermore, the first engaging part includes a first connecting section, a second connecting section opposite to the first connecting section, and a third connecting section configured to connect the first connecting section to the second connecting section. One end of the first connecting section is connected to the second engaging part. The other end of the first connecting section is connected to one end of the third connecting section. One end of the second connecting section is connected to the third engaging part. The other end of the second connecting section is connected to the other end of the third connecting section.

Furthermore, a bottom wall of the accommodating groove includes a first opening. The guiding rail includes a board having a second opening, the first opening matching the second opening. The sliding structure further includes a fixing member. The fixing member operatively penetrates the first opening and the second opening to connect the guiding rail with the support member.

Furthermore, the fixing member includes a first fixing end abutting against a surface of the support member. The surface is away from the guiding rail. The fixing member further includes a second fixing end opposite to the first fixing end. The second fixing end abuts against a surface of the board, which is away from the connecting member. The fixing member also includes a connecting end connecting the first fixing end and the second fixing end. The connecting end is received in the first opening and the second opening.

Furthermore, the accommodating groove includes two opposite groove walls, at least one of the two groove walls being provided with a convex rib. The guiding rail further includes two opposite flanges. The two flanges are convexly disposed on two side portions of the board, respectively. An outer surface of at least one of the two flanges is concavely provided with a guiding groove. The convex rib is received in the guiding groove.

Furthermore, free ends of the two groove walls are bent towards each other to form two holding sections. Free ends of the two flanges are bent towards each other to form two inclined sections. Each of the two flanges is provided on the corresponding groove wall. Each of the two holding sections is configured to abut against the corresponding inclined section.

According to another exemplary aspect of the present disclosure, a basket is provided. The basket includes a basket body and at least one sliding structure connected to the basket body. The sliding structure includes a connecting member connected to the basket body, at least one support member connected to the connecting member, and a guiding rail connected to the support member and received in the accommodating groove. The support member includes an engaging groove and an accommodating groove spaced from the engaging groove, and one end of the connecting member is engaged in the engaging groove.

Furthermore, the connecting member includes a connecting rod connected to the basket body, and at least one bending section engaged in the engaging groove and connected to an end of the connecting rod. An angle is defined between the bending section and the end of the connecting rod.

Furthermore, the at least one bending section includes two bending sections, the two bending sections being connected to two ends of the connecting rod respectively; and the at least one support member includes two support members, each of the two bending sections being engaged in one corresponding engaging groove, one end of the guiding rail being received in one of the two accommodating grooves, and the other end of the guiding rail being received in the other one of the two accommodating grooves; and/or the connecting member further includes at least one abutting section connected to a free end of the bending section, an angle being defined between the abutting section and the bending section, and the abutting section being configured to abut against an outer surface of the engaging groove; and/or the engaging groove includes two opposite side walls and at least one accommodating space, the side wall being configured to recess outwardly to form the accommodating space, and the bending section being received in the accommodating space; and the sliding structure further includes an engaging block, the engaging block being received in the engaging groove and abutting against the bending section.

Furthermore, a bottom wall of the accommodating groove includes a first opening. The guiding rail includes a board having a second opening, the first opening matching the second opening. The sliding structure further includes a fixing member, the fixing member penetrating the first opening and the second opening to connect the guiding rail with the support member.

Furthermore, the fixing member includes a first fixing end abutting against a surface of the support member away from the guiding rail, a second fixing end opposite to the first fixing end and abutting against a surface of the board away from the connecting member, and a connecting end connecting the first fixing end and the second fixing end, the connecting end being received in the first opening and the second opening; and/or the accommodating groove includes two opposite groove walls, at least one of the two groove walls being provided with a convex rib. The guiding rail further includes two opposite flanges, the two flanges being convexly disposed on two side portions of the board respectively, an outer surface of at least one of the two flanges being concavely provided with a guiding groove, and the convex rib being received in the guiding groove.

According to still another exemplary aspect of the present disclosure, a dish washer is provided. The dish washer includes a basket. The basket includes a basket body, and at least one sliding structure connected to the basket body. The sliding structure includes a connecting member connected to the basket body; at least one support member connected to the connecting member, the support member including an engaging groove and an accommodating groove spaced from the engaging groove, and one end of the connecting member being engaged in the engaging groove; and a guiding rail connected to the support member and received in the accommodating groove.

The sliding structure of the present disclosure is configured to drive or actuate the basket to move. The sliding structure includes a connecting member connected to the basket, at least one support member connected to the connecting member, and a guiding rail connected to the support member. The support member is provided with an engaging groove and an accommodating groove spaced from the engaging groove. One end of the connecting member is engaged in the engaging groove, and the guiding rail is received in the accommodating groove. During pulling and pushing processes of the basket, the support member would not move relative to the guiding rail as the support member is fixed to the guiding rail. As such, no noise would be generated. The support member would not shake during the processes of pushing and pulling the basket as the guiding rail is firmly accommodated in the accommodating groove of the support member. Due to a surface-to-surface contact mode between the support member and the guiding rail, the dish washer including the sliding structure has better stability and load bearing capacity.

During a mounting process of the dish washer, one end of the connecting member connected to the basket is engaged in the engaging groove of the support member, subsequently, the guiding rail is provided in the accommodating groove of the support member. It only needs to remove the connecting member from the engaging groove, and remove the guiding rail from the accommodating groove, for disassembling the dish washer. Therefore, the installation and disassembly of the dish washer is simple.

BRIEF DESCRIPTION OF THE DRAWINGS

In order to more clearly illustrate the embodiments of the present disclosure or the technical solutions in the prior art, the drawings to be used in the embodiments or description of the prior art will be briefly described below. Obviously, the drawings in the following description are only certain embodiments of the present disclosure, and other drawings may be obtained according to the structures shown in the drawings without any creative work for a person having ordinary skill in the art.

The implementation, functional features and advantages of the present disclosure will be further described with reference to the accompanying drawings.

DETAILED DESCRIPTION OF THE EMBODIMENTS

The technical solutions in the embodiments of the present disclosure are clearly and completely described in the following with reference to the drawings in the embodiments of the present disclosure. It is obvious that the described embodiments are only a part of the embodiments of the present disclosure, and not all of the embodiments. Based on the embodiments in this application, all other embodiments obtained by a person having ordinary skill in the art without making any creative work fall within the scope of this application.

It should be noted that all directional indications (such as up, down, left, right, front, rear, . . . ) in the embodiments of the present disclosure are only used to explain the relative position relationship, the movement, etc. between the components in a specific posture (as shown in the attached drawings). If the specific posture is changed, the directional indication will be changed accordingly.

In addition, the descriptions of "first", "second", etc., in this application are used for descriptive purposes only, and are not to be construed as indicating or implying their relative importance or implicitly indicating the number of technical features indicated. Thus, features defining "first" or "second" may include at least one of the features, either explicitly or implicitly. In addition, the technical solutions between the various embodiments of the present disclosure may be combined with each other, but must be based on the realization of a person having ordinary skill in the art, when the combination of technical solutions is contradictory or unrealizable, it shall be deemed that such combination of technical solutions does not exist and is not within the scope of this application.

Figure 1:
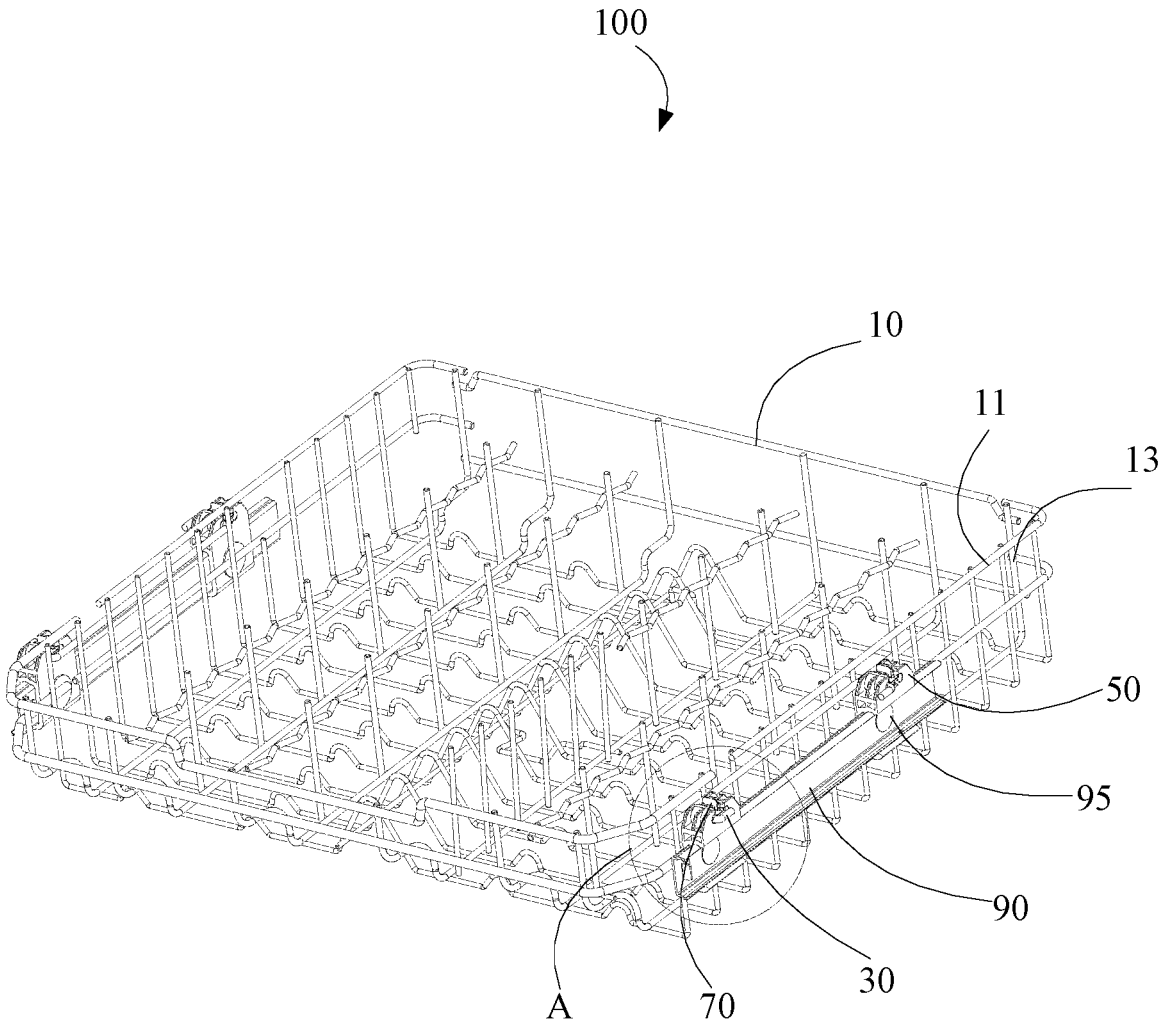
FIG. 1 is a schematic perspective view of a basket according to an embodiment of the present disclosure.
Figure 2:
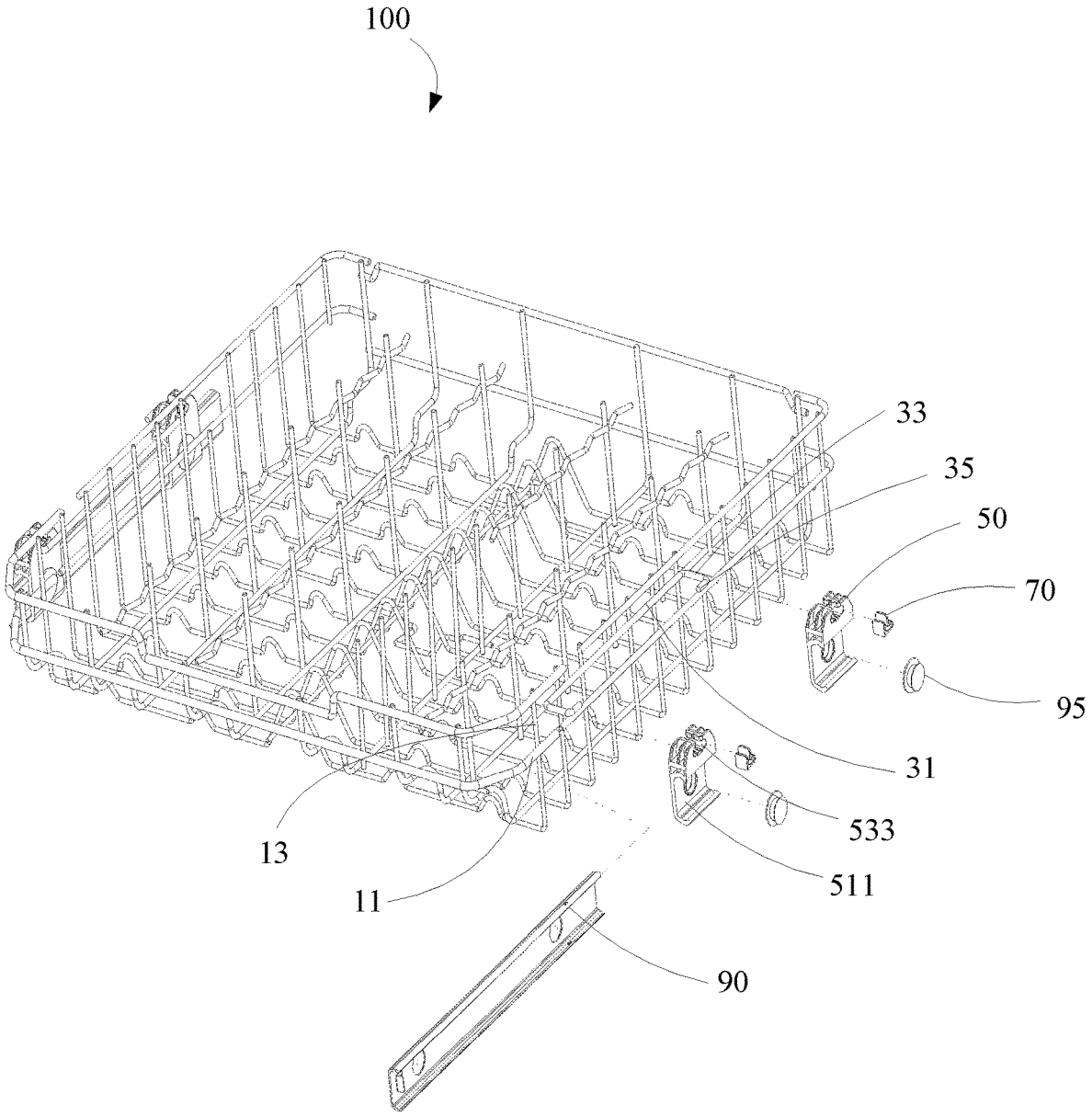
FIG. 2 is an exploded perspective view of the basket as shown in FIG. 1.
Figure 3:
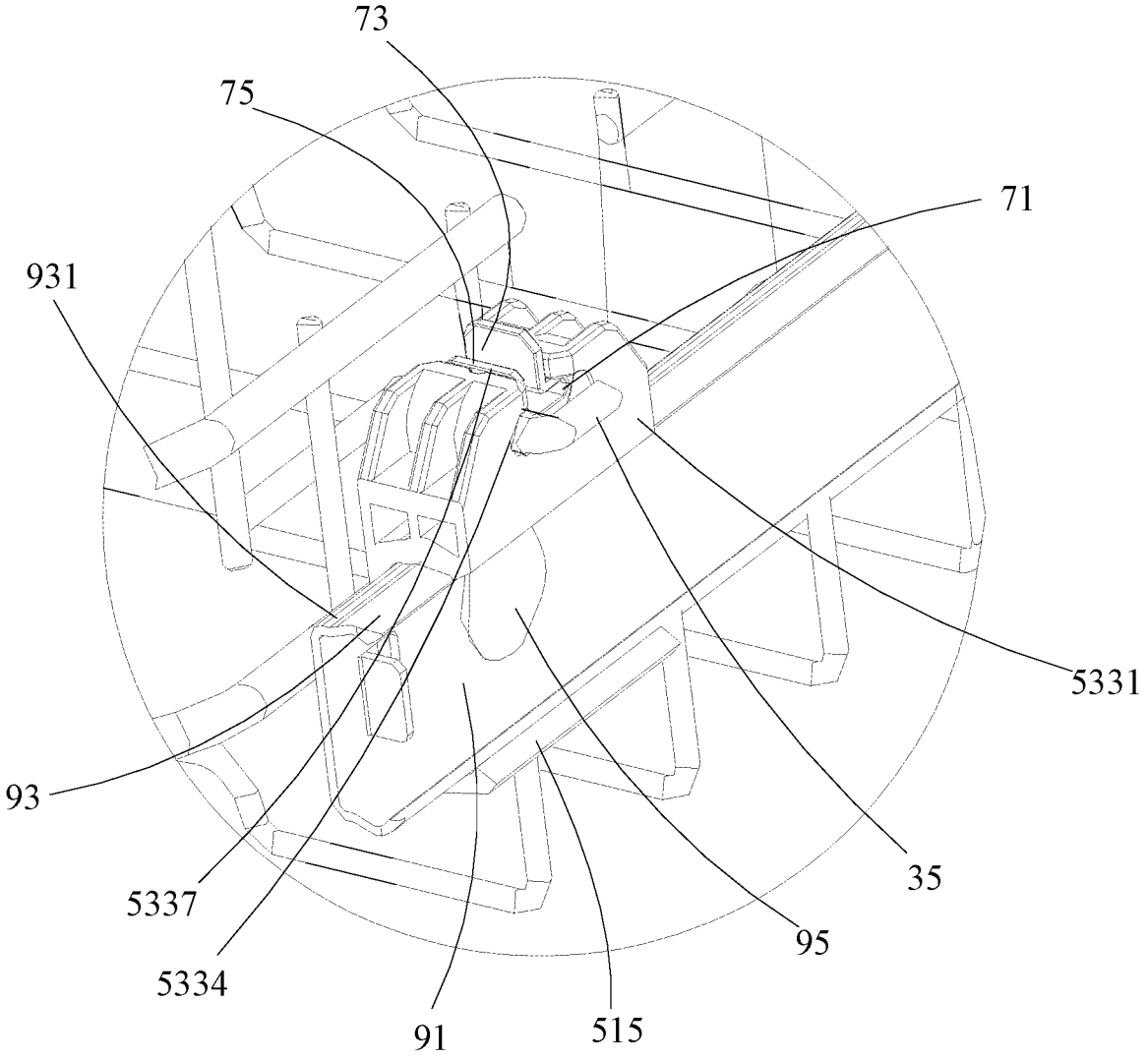
FIG. 3 is an enlarged perspective view of portion A as shown in FIG. 1.
Figure 4:
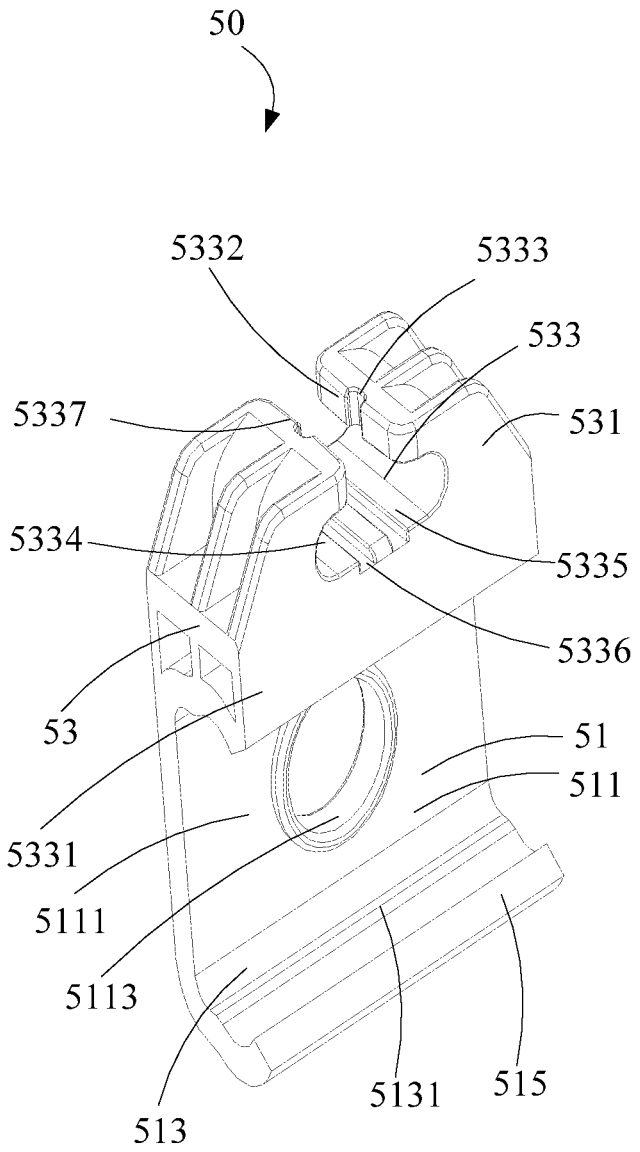
FIG. 4 is a schematic perspective view of a support member of the basket as shown in FIG. 1.
Figure 5:
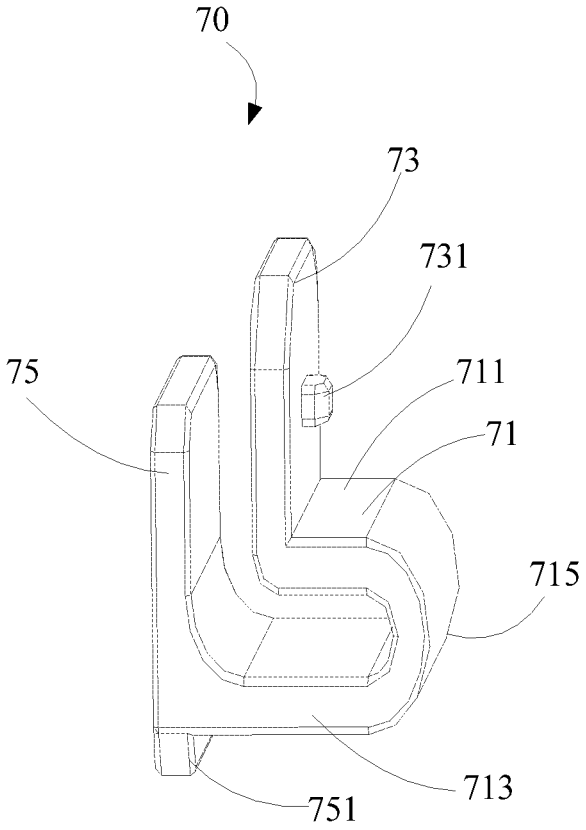
FIG. 5 is a schematic perspective view of an engaging block of the basket as shown in FIG. 1.
Figure 6:
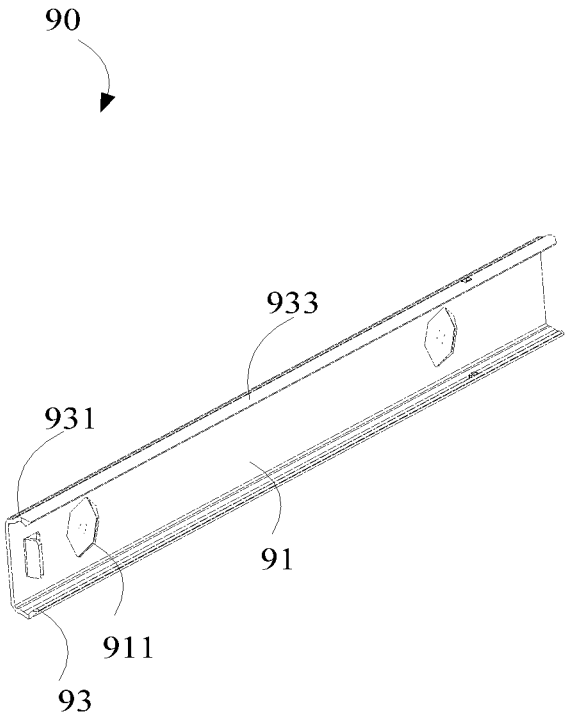
FIG. 6 is a schematic perspective view of a guiding rail of the basket as shown in FIG. 1.
Figure 7:
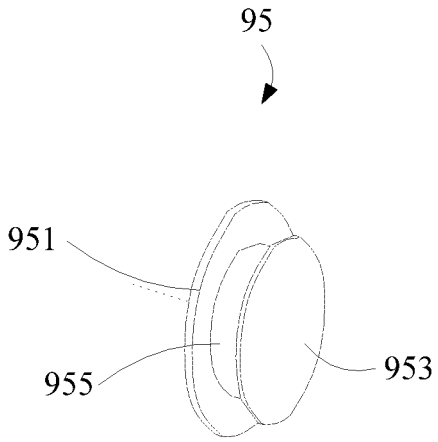
FIG. 7 is a schematic perspective view of a fixing member of the basket as shown in FIG. 1.

Referring to FIGS. 1 to 7, the present disclosure provides a sliding structure, which is configured to enable or actuate a basket 100 to move.

The sliding structure includes a connecting member 30 connected to the basket 100, at least one support member 50 connected to the connecting member 30, and a guiding rail 90 connected to the support member 50. The support member 50 has an engaging groove 533 and an accommodating groove 511 spaced from the engaging groove 533. One end of the connecting member 30 is engaged in the engaging groove 533. The guiding rail 90 is received in the accommodating groove 511.

In some embodiments of the present disclosure, the support member 50 includes a first accommodating portion 51 and a second accommodating portion 53 provided at one end of the first accommodating portion 51. The first accommodating portion 51 is concavely formed with the accommodating groove 511. One end 531 of the second accommodating portion 53 remote from the first accommodating portion 51 has the engaging groove 533 and an opening 5337 communicating or continuous with the engaging groove 533. The connecting member 30 is configured to pass through the the opening 5337 and extend into the engaging groove 533.

The sliding structure of the present disclosure is configured to drive the basket 100 to move. The sliding structure includes a connecting member 30 connected to the basket 100, at least one support member 50 connected to the connecting member 30, and a guiding rail 90 connected to the support member 50. The support member 50 is provided with an engaging groove 533 and an accommodating groove 511 spaced from the engaging groove 533. One end of the connecting member 30 is engaged in the engaging groove 533, and the guiding rail 90 is received in the accommodating groove 511. During pulling and pushing processes of the basket 100, the support member 50 would not move relative to the guiding rail 90 as the support member 50 is fixed to the guiding rail 90. As such no noise would be generated. The support member 50 would not shake during the processes of pushing and pulling the basket 100 as the guiding rail 90 is firmly accommodated in the accommodating groove 511 of the support member 50. Compared to a point-line contact mode, a surface-to-surface contact mode between the support member 50 and the guiding rail 90 enables the guiding rail 90 to have a large force bearing area for transmitting the force of the support member 50 to the guiding rail 90, so that the dish washer including the sliding structure has better stability and load bearing capacity. Compared with the technical solution of driving the basket to move through the rollers in the related art, the present disclosure does not adopt rollers, which avoids the phenomenon of stagnation during the process of pulling the basket 100. Further, since there are no rollers, the dish washer of the present disclosure has the advantages of low processing difficulty, low cost and high efficiency, etc.

During a mounting process of the dish washer, one end of the connecting member 30 connected to the basket 100 is engaged in the engaging groove 533 of the support member 50, then the guiding rail 90 is provided in the accommodating groove 511 of the support member 50. It only needs to remove the connecting member 30 from the engaging groove 533, and remove the guiding rail 90 from the accommodating groove 511, for disassembling the dish washer. Therefore, the installation and disassembly of the dish washer is simple.

The connecting member 30 includes a connecting rod 31 connected to the basket 100 and at least one bending section 33 engaged in the engaging groove 533 and connected to an end of the connecting rod 31. An angle is defined between the bending section 33 and the end of the connecting rod 31.

In some embodiments of the present application, the connecting rod 31 has a cylindrical structure. It would be understood that the connecting rod 31 may also have other shapes, such as an elongated shape, which is not limited in this present disclosure.

The connecting rod 31 is connected to a basket body 10 of the basket 100. It would be understood that the connecting rod 31 can be fixedly connected or detachably connected to the basket body 10.

In some embodiments of the present disclosure, the connecting rod 31 may be fixed to the basket body 10 by welding.

In some embodiments of the present disclosure, the connecting rod 31 may be detachably fixed to the basket body 10 by a clamping manner.

It would be understood that the included angle between the bending section 33 and the end of the connecting rod 31 ranges from 80° to 100°.

In some embodiments of the present disclosure, the included angle between the bending section 33 and the end of the connecting rod 31 is 90°.

In the technical solution of the present disclosure, the connecting member 30 includes the connecting rod 31 fixedly connected to the basket body 10 and the at least one bending section 33 engaged in the engaging groove 533, and an angle is defined between the bending section 33 and the connecting rod 31. As such, the basket body 10 may be fixedly connected to the support member 50 through the connecting member 30.

In some embodiments of the present disclosure, the connecting member 30 includes two bending sections 33, the two bending sections 33 are connected to two ends of the connecting rod 31 respectively. The sliding structure includes the support member 50, and each bending section 33 is engaged in one corresponding engaging groove 533, one end of the guiding rail 90 is received in a first accommodating groove 511, and the other end of the guiding rail 90 is received in a second accommodation groove 511.

It would be understood that the two ends of the connecting rod 31 two can be configured to bend and extend to form the two bending sections 33, respectively.

In some embodiments of the present disclosure, the two support members 50 may be arranged at intervals or in contact with each other.

In the technical solution of the present disclosure, the connecting member 30 includes two bending sections 33, and the sliding structure includes two support members 50. Each support member 50 is formed with an engaging groove 533 and an accommodating groove 511. Each bending section 33 is received in one corresponding engaging groove 533, two ends of the guiding rail 90 are received in corresponding accommodating grooves 511, respectively, so that the connecting member 30 may be firmly connected to the support member 50, and the guiding rail 90 may also be firmly connected to the support member 50, thereby ensuring that the dish washer having the sliding structure has better stability in operation.

The connecting member further includes at least one abutting section 35 connected to a free end of the bending section 33, an angle is defined between the abutting section 35 and the bending section 33, and the abutting section 35 is configured to abut against an outer surface of the engaging groove 533.

It would be understood that the abutting section 35 can be formed by bending and extending the free end of the bending section 33.

In some embodiments of the present disclosure, the connecting member 30 includes two bending sections 33, both ends of each bending section 33 are bent and extended to form two abutting sections 35, and the two abutting sections 35 are configured to abut against corresponding outer surfaces 5331 of the engaging groove 533, respectively.

In some embodiments of the present disclosure, free ends of the two abutting sections 35 are arranged towards each other, arranged away from each other, or arranged along a same direction.

It would be understood that the included angle between the bending section 33 and the abutting section 35 ranges from 80° to 100°.

In some embodiments of the present disclosure, the included angle between the bending section 33 and the abutting section 35 is 90°.

In the technical solution of the present disclosure, the connecting member 30 further includes the at least one abutting section 35 connected to the free end of the bending section 33, and an included angle is formed between the bending section 33 and the abutting section 35, so that the abutting section 35 may be configured to abut against the outer surface 5331 of the engaging groove 533, thereby further increasing the reliability of the connection between the connecting member 30 and the support member 50.

The engaging groove 533 includes two opposite side walls 5332 and at least one accommodating space 5334. The side wall 5332 is configured to recess outwardly to form the accommodating space 5334, and the bending section 33 is received in the accommodating space 5334. The sliding structure further includes an engaging block 70, and the engaging block 70 is received in the engaging groove 533 and abutting against the bending section 33.

It would be understood that the accommodating space 5334 has a structure matching the bending section 33, so that the bending section 33 can be firmly received in the accommodating space 5334. After the bending section 33 is accommodated in the accommodating space 5334, the side wall of the accommodating space 5334 can restrict the bending section 33 from moving in the vertical direction, that is, the bending section 33 is restricted from moving in the vertical direction.

It would be understood that the engaging block 70 is received in the engaging groove 533 and resists the bending section 33, thereby restricting the bending section 33 from moving in the horizontal direction. That is, the bending section 33 is restricted from moving along a left-right direction.

In the technical solution of the present disclosure, the engaging groove 533 includes the two oppositely disposed side walls 5332 and the at least one accommodating space 5334. The accommodating space 5334 is formed by recessing the side wall 5332 outwardly. The bending section 33 is accommodated in the accommodating space 5334, so that the side wall of the accommodating space 5334 can restrict the bending section 33 from moving in a vertical direction. The sliding structure further includes the engaging block 70 received in the engaging groove 533 and resisting the bending section 33, so as to restrict the bending section 33 from moving in the horizontal direction.

The engaging groove 533 can include two opposite accommodating spaces 5334. Each of the two side walls 5332 is configured to recess outwardly to form one corresponding accommodating space 5334. The engaging block 70 has a first engaging part 71, and the first engaging part 71 is engaged in a corresponding accommodating space 5334.

It would be understood that the two side walls 5332 can be both recessed outwardly to form two accommodating spaces 5334. The two accommodating spaces 5334 may be defined as a part of the engaging groove 533. At this time, the bending section 33 is accommodated in one of the accommodating spaces 5334, and the engaging block 70 is accommodated in the remaining area of the engaging groove 533 to resist the bending section 33, thereby limiting the bending segment 33 from moving in the horizontal direction. That is, the bending segment 33 is restricted from moving along the left-right direction.

It would be understood that the first engaging part 71 of the engaging block 70 can be received in the other one of the accommodating spaces 5334, so that the engaging block 70 may be firmly received in the engaging groove 533, for limiting the bending section 33 reliably.

It would be understood that the vertical section of the first engaging part 71 can be of a U-shape. The accommodating space 5334 has a shape matching the first engaging part 71, so that the first engaging part 71 may be firmly received in the accommodating space 5334.

In the technical solution of the present disclosure, the engaging groove 533 includes two oppositely disposed accommodating spaces 5334. Each of the two side walls 5332 is configured to recess outwardly to form one corresponding accommodating space 5334. The engaging block 70 has the first engaging part 71, the bending section 33 is received in one of the accommodating spaces 5334, and the first engaging part 71 is engaged in the other one of the accommodating spaces 5334, so that the bending section 33 can be firmly accommodated in the corresponding accommodating space 5334.

The side wall 5332 adjacent to the engaging block 70 includes a clamping groove 5333 communicated or continuous with the opening 5337 and the engaging groove 533. The engaging block 70 further includes a second engaging part 73 connected to the first engaging part 71. An angle is formed between the first engaging part 71 and the second engaging part 73. The second engaging part 73 includes a first protrusion 731 received in the clamping groove 5333.

It would be understood that the included angle between the second engaging part 73 and the first engaging part 71 ranges from 80° to 100°.

In some embodiments, the included angle between the second engaging part 73 and the first engaging part 71 is 90°.

In some embodiments of the present disclosure, both side walls of the support member 50 are provided with one clamping groove 5333. In this way, when the bending section 33 can be selectively accommodated in any one of the two accommodating spaces 5334, the first engaging part 71 can be accommodated in the other one of the accommodating spaces 5334. The first protrusion 731 may be accommodated in the corresponding clamping groove 5333, so that the engaging block 70 and the bending section 33 may be easily and quickly mounted on the support member 50. Moreover, since the two side walls 5332 of the support member 50 are both recessed outwardly to form the accommodating spaces 5334, and the two side walls 5332 are provided with the clamping grooves 5333, so that the support member 50 is universal, that is, several support members 50 may be universally provided on two sides of the basket body 10 and located at two ends of each side respectively.

In the technical solution of the present disclosure, the side wall 5332 is further provided with the clamping groove 5333. The engaging block 70 further includes the second engaging part 73 connected to the first engaging part 71, and an included angle is formed between the second engaging part 73 and the first engaging part 71. The second engaging part 73 is provided with a first protrusion 731 which is received in the clamping groove 5333, to increase the stability of the connection between the engaging block 70 and the support member 50 and limit the bending section 33 reliably.

The engaging block 70 can further include a third engaging part 75 disposed oppositely to the second engaging part 73. The second engaging part 73 is connected to one end of the first engaging part 71. The third engaging part 75 is connected to the other end of the first engaging part 71, and the third engaging part 75 abuts against the bending section 33.

It would be understood that the third engaging part 75 is disposed in parallel with the second engaging part 73.

In some embodiments of the present disclosure, the first engaging part 71 is received in the accommodating space 5334, and the second engaging part 73 and the third engaging part 75 are received in the engaging groove 533. Since the third engaging part 75 is disposed near the bending section 33, the third engaging part 75 may be configured to abut against the bending section 33.

In the technical solution of the present disclosure, the engaging block 70 further includes the third engaging part 75 disposed opposite to the second engaging part 73. The second engaging part 73 is connected to one end of the first engaging part 71, and the third engaging part 75 is connected to the other end of the first engaging part 71. After the first engaging part 71 is received in the accommodating space 5334, the third engaging part 75 may abut against the bending section 33 to limit the bending section 33.

A second protrusion 751 extends from one end of the third engaging part 75 connected to the first engaging part 71. A groove 5336 is formed at the bottom wall 5335 of the engaging groove 533, and the second protrusion 751 is received in the groove 5336.

In some embodiments of the present disclosure, the bottom wall 5335 of the engaging groove 533 is provided with two grooves 5336 spaced apart from each other, so that no matter which accommodating space 5334 the first engaging part 71 is accommodated in, the second protrusion 751 may be received in one of the grooves 5336 to firmly connect the engaging block 70 with the support member 50, so that the engaging block 70 can restrict the bending section 33 from moving in the horizontal direction.

In the technical solution of the present disclosure, the second protrusion 751 is provided to extend from an end of the third engaging part 75 connected to the first engaging part 71, the bottom wall 5335 of the engaging groove 533 is provided with the groove 5336, and the second protrusion 751 is received in the groove 5336, so that the engaging block 70 is firmly connected with the support member 50 and the engaging block 70 can restrict the bending section 33 from moving in the horizontal direction.

The first engaging part 71 includes a first connecting section 711, a second connecting section 713 disposed opposite to the first connecting section 711, and a third connecting section 715 connected to the first connecting section 711 and the second connecting section 713. One end of the first connecting section 711 is connected to the second engaging part 71, and the other end of the first connecting section 711 is connected to one end of the third connecting section 715. One end of the second connecting section 713 is connected to the third engaging part 75, and the other end of the second connecting section 713 is connected to the other end of the third connecting section 715.

In some embodiments of the present disclosure, the first connecting section 711 and the second connecting section 713 each have a flat plate structure, and the first connecting section 711 and the second connecting section 713 are arranged in parallel.

In some embodiments of the present disclosure, the third connecting section 715 has an arc-shaped structure, so that the first engaging part 71 is inserted into the accommodating space 5334 easily. It would be understood that the bottom wall of the accommodating space 5334 has a structure matching the arc structure.

It would be understood that the first connecting section 711, the second connecting section 713, and the third connecting section 715 collectively form a U-shaped structure.

In the technical solution of the present disclosure, the first engaging part 71 includes the first connecting section 711, the second connecting section 713 disposed opposite to the first connecting section 711, and the third connecting section 715 connected to the first connecting section 711 and the second connecting section 713. One end of the first connecting section 711 is connected to the second engaging part 71, and the other end of the first connecting section 711 is connected to one end of the third connecting section 715. One end of the second connecting section 713 is connected to the third engaging section 75, and the other end of the second connecting section 713 is connected to the other end of the third connecting section 715, so that the first engaging part 71 is connected to both the second engaging part 73 and the third engaging part 75.

The bottom wall 5111 of the accommodating groove 511 is provided with a first opening 5113. The guiding rail 90 includes a board 91. The board 91 is provided with a second opening 911. The first opening 5113 matches the second opening 911. The sliding structure further includes a fixing member 95. The fixing member 95 passes through the first opening 5113 and the second opening 911 to connect the guiding rail 90 with the support member 50.

In some embodiments of the present disclosure, the board 91 is provided with at least two second openings 911 arranged at intervals. Understandably, when two support members 50 are provided on both sides of the basket body 10, the board 91 is provided with two spaced-apart second openings 911, and each support member 50 has one first opening 5113, so that each second opening 911 is corresponding to one first opening 5113.

In the technical solution of the present disclosure, the bottom wall 5111 of the accommodating groove 511 is provided with the first opening 5113, the board 91 is provided with the second opening 911. The sliding structure further includes the fixing member 95, and the fixing member 95 passes through the first opening 5113 and the second opening 911 to connect the guiding rail 90 with the support member 50. Thus, there is no relative movement between the guiding rail 90 and the support member 50. As a result, during the process of pulling the basket 100, no noise is generated when there is no relative movement between the guiding rail 90 and the support member 50.

The fixing member 95 includes a first fixing end 951, a second fixing end 953 disposed opposite to the first fixing end 951, and a connecting end 955 connecting the first fixing end 951 and the second fixing end 953. The first fixing end 951 abuts the surface of the support member 50 away from the guiding rail 90, the connecting end 955 is received in the first opening 5113 and the second opening 911, and the second fixing end 953 abuts the board 91 away from the surface of the connecting member 30.

It would be understood that the diameter of the first fixing end 951 is larger than the diameter of the first opening 5113, so that the first fixing end 951 can abut the outer peripheral of the first opening 5113. The diameter of the second fixing end 953 is larger than the diameter of the second opening 911, so that the second fixing end 953 can abut against the outer periphery of the second opening 911.

It would be understood that, in the present disclosure, screws and pins may be used instead of the fixing member 95 to connect the support member 50 with the guiding rail 90.

It can be understood that an opening may be provided in one of the support member 50 and the rail 90, the other one is convexly provided with an engaging member, and the engaging member is engaged in the opening, for fixedly connecting the support member 50 to the guiding rail 90 and avoiding the using of the fixing member 95.

The present disclosure does not limit the connection manner between the support member 50 and the guiding rail 90. Other suitable implements for connecting the support member 50 and the guiding rail 90 fall within the scope of the present disclosure.

In the technical solution of the present disclosure, the fixing member 95 includes the first fixing end 951, the second fixing end 953 disposed opposite to the first fixing end 951, and the connecting end 955 connected to the first fixing end 951 and the second fixing end 953. The first fixing end 951 abuts against the surface of the support member 50 away from the guiding rail 90. The connecting end 955 is received in the first opening 5113 and the second opening 911. The second fixing end 953 abuts the surface of the board 91 away from the connecting member 30, so that the fixing member 95 can firmly connect the support member 50 and the guiding rail 90, to ensure that there is no relative movement between the guiding rail 90 and the support member 50.

The accommodating groove 511 includes two opposite groove walls 513, and at least one of the groove walls 513 is convexly provided with a convex rib 5131. The guiding rail 90 further includes two opposite flanges 93, and the two flanges 93 are respectively protruded from two side portions of the board 91. An outer surface of at least one of the two flanges 93 is concavely provided with a guiding groove 931, and the convex rib 5131 is received in the guiding groove 931.

It would be understood that the outer surface of the accommodating groove 511 may be recessed inwardly to form the convex rib 5131.

It would be understood that the structure of the convex rib 5131 matches the structure of the guiding groove 931, so that the guiding rail 90 and the support member 50 can be firmly connected together.

In some embodiments of the present disclosure, two groove walls 513 of the accommodating groove 511 both have the convex rib 5131. The two flanges 93 are both provided with the guiding groove 931. Each of the convex ribs 5131 is received in one corresponding guiding groove 931.

In the technical solution of the present disclosure, the accommodating groove 511 includes two oppositely disposed groove walls 513, at least one of the two groove walls 513 is convexly provided with the convex rib 5131. The guiding rail 90 further includes two oppositely disposed flanges 93. The two flanges 93 are respectively protruded from the two side portions of the board 91. One outer surface of at least one of the flanges 93 is recessed with a guiding groove 931, and the convex rib 5131 is received in the guiding groove 931, to allow the guiding rail 90 to be firmly connected to the support member 50, which additionally avoids the relative movement between the guiding rail 90 and the support member 50 during the process of pulling the basket 100.

Free ends of the two groove walls 513 are bent towards each other to form two holding sections 515. Free ends of the two flanges 93 are bent towards each other to form two inclined sections 933, each of the two flanges 93 is provided on the corresponding groove wall 513, and each of the two holding sections 515 is configured to abut against the corresponding inclined section 933.

It would be understood that the structure of the holding section 515 matches the structure of the inclined section 933.

In the technical solution of the present disclosure, the free ends of the two groove walls 513 are bent in opposite directions to form two holding sections 515, and the free ends of the two flanges 93 are bent in opposite directions to form two inclined sections 933, each of the two flanges 93 is provided on the corresponding groove wall 513, and each of the two holding sections 515 is configured to abut against the corresponding inclined section 933, to further enhance the connection between the guiding rail 90 and the support member 50.

The present disclosure further provides a basket 100, which includes a basket body 10 and at least one sliding structure connected to the basket body 10. The sliding structure includes the connecting member 30 connected to the basket body 10, the at least one support member 50 connected to the connecting member 30, and the guiding 90 connected to the support member 50. The support member 50 has the engaging groove 533 and the accommodating groove 511 spaced from the engaging groove, one end of the connecting member 30 is engaged in the engaging groove 533, and the guiding rail 90 is received in the accommodating groove 511.

It should be noted that the basket 100 may be configured to place articles to be washed, such as tableware and the like.

In some embodiments of the present disclosure, the basket 100 includes two connecting members 30, two guiding rails 90, and four support members 50. The basket body 10 includes two oppositely disposed sides, each side is connected to one connecting member 30. Each end of each connecting member 30 is formed with a bending section 33 and an abutting section 35. Each bending section 33 is received in one corresponding accommodating space 5334 of the supporting member 50. Each holding section 35 abuts against the outer surface 5331, and each guiding rail 90 is received in two corresponding accommodating groove 511 of the two support members 50.

Since the basket 100 adopts all the technical solutions of all the above embodiments, it has at least all the beneficial effects brought by the technical solutions of the above embodiments, which will not be described in detail here.

In some embodiments of the present disclosure, the basket body 10 includes a frame bar 11 and a connecting bar 13, the connecting bar 13 is fixed to the frame bar 11 at intervals along a circumferential of the frame bar 11, and the frame bar 11 and the connecting bar 13 forms a storage space for accommodating dishes, such as bowls.

It would be understood that the frame bar 11 and the connecting bar 13 may be fixed together by welding, thereby increasing the stability of the basket 10.

The present disclosure also provides a dish washer, which includes a basket 100. The basket 100 includes a basket body 10, and a sliding structure connected to the basket body 10. The sliding structure includes the connecting member 30 connected to the basket body 10, the at least one support member 50 connected to the connection member 30, and the guiding rail 90 connected to the support member 50. The support member 50 is provided with the engaging groove 533 and the accommodating groove 511 spaced from the engaging groove 533. One end of the connecting member 30 is engaged in the engaging groove 533, and the guiding rail 90 is received in the accommodating groove 511.

Since this dish washer adopts all the technical solutions of all the above embodiments, it has at least all the beneficial effects brought by the technical solutions of the above embodiments, which will not be described in detail here.

It would be understood that the dish washer also includes other necessary components to achieve the dishwashing function of the dish washer, such as an inner tank (not shown) and a circulating spray system (not shown). A washing chamber configured to wash dishes is formed in the inner tank, and the circulating spray system is arranged in the washing chamber to wash dishes.

In some embodiments of the present disclosure, a side wall of the inner tank is further provided with a carrying rail (not shown), and the guiding rail 90 is movably provided on the carrying rail. During the process of pulling the basket 100, the guiding rail 90 may move on the carrying rail to pull out the basket 100 or push the basket 100 into the inner tank.

In the description of the present disclosure, the descriptive terms of "one embodiment", "certain embodiments", "exemplary embodiments", "examples", "specific examples", or "some examples", etc., mean that the specific features, structures, materials, or characteristics described in the embodiments or examples are included in at least one embodiment or example of the present disclosure. In this present disclosure, the schematic expressions of the above terms do not necessarily refer to the same embodiment or example. Moreover, the particular features, structures, materials, or characteristics described may be combined in any suitable manner in any one or more embodiments or examples.

The above are only preferred embodiments of the present disclosure, and thus do not limit the scope of the present disclosure. Any equivalent structure or equivalent process transformation made by using the description and drawings of the present disclosure is included in the scope of the present disclosure.

We claim:

1. A sliding structure, configured to enable a basket to move, comprising:

a connecting member connected to the basket;

at least one support member connected to the connecting member, the at least one support member comprising an engaging groove and an accommodating groove spaced from the engaging groove, and one end of the connecting member being engaged in the engaging groove; and a guiding rail connected to the at least one support member and received in the accommodating groove, wherein the connecting member comprises:

a connecting rod connected to the basket, and at least one bending section engaged in the engaging groove and connected to an end of the connecting rod, an angle being defined between the at least one bending section and the end of the connecting rod; and wherein the engaging groove comprises:

two opposite side walls; and at least one accommodating space, the two opposite side walls being configured to recess outwardly to form the at least one accommodating space, and the at least one bending section being received in the at least one accommodating space; and wherein the sliding structure further comprises an engaging block, the engaging block being received in the engaging groove and abutting against the at least one bending section.

2. The sliding structure of claim 1, wherein:

the at least one bending section comprises two bending sections, the two bending sections being connected to two ends of the connecting rod respectively; and the at least one support member comprises two support members, each of the two bending sections being engaged in one corresponding engaging groove, one end of the guiding rail being received in one of the two accommodating grooves, and the other end of the guiding rail being received in the other one of the two accommodating grooves.

3. The sliding structure of claim 1, wherein the connecting member further comprises:

at least one abutting section connected to a free end of the at least one bending section, an angle being defined between the at least one abutting section and the at least one bending section, and the at least one abutting section being configured to abut against an outer surface of the engaging groove.

4. The sliding structure of claim 1, wherein:

the at least one accommodating space comprises two opposite accommodating spaces, each of the two side walls being configured to recess outwardly to form one corresponding accommodating space; and the engaging block comprises a first engaging part, the first engaging part being engaged in a corresponding accommodation space.

5. The sliding structure of claim 4, wherein:

the side wall adjacent to the engaging block comprises a clamping groove; and the engaging block further comprises: a second engaging part connected to the first engaging part, an angle being formed between the first engaging part and the second engaging part, and the second engaging part comprising a first protrusion received in the clamping groove.

6. The sliding structure of claim 5, wherein the engaging block further comprises:

a third engaging part opposite to the second engaging part, the second engaging part being connected to one end of the first engaging part, the third engaging part being connected to the other end of the first engaging part, and the third engaging part being configured to abut against the at least one bending section.

7. The sliding structure of claim 6, wherein:

an end of the third engaging part connected to the first engaging part is provided with a second protrusion; and a bottom wall of the engaging groove comprises a groove, the second protrusion being received in the groove.

8. The sliding structure of claim 6, wherein the first engaging part comprises:

a first connecting section;

a second connecting section opposite to the first connecting section; and a third connecting section configured to connect the first connecting section to the second connecting section, one end of the first connecting section being connected to the second engaging part, the other end of the first connecting section being connected to one end of the third connecting section, one end of the second connecting section being connected to the third engaging part, and the other end of the second connecting section being connected to the other end of the third connecting section.

9. The sliding structure of claim 1, wherein:

a bottom wall of the accommodating groove comprises a first opening;

the guiding rail comprises:

a board comprising a second opening, the first opening matching the second opening; and the sliding structure further comprises a fixing member, the fixing member penetrating the first opening and the second opening to connect the guiding rail with the at least one support member.

10. The sliding structure of claim 9, wherein the fixing member comprises:

a first fixing end abutting against a surface of the at least one support member away from the guiding rail;

a second fixing end opposite to the first fixing end and abutting against a surface of the board, wherein the surface is away from the connecting member; and a connecting end connecting the first fixing end and the second fixing end, the connecting end being received in the first opening and the second opening.

11. The sliding structure of claim 9, wherein the accommodating groove comprises:

two opposite groove walls, at least one of the two groove walls being provided with a convex rib; and the guiding rail further comprises two opposite flanges, the two flanges being convexly disposed on two side portions of the board respectively, an outer surface of at least one of the two flanges being concavely provided with a guiding groove, and the convex rib being received in the guiding groove.

12. The sliding structure of claim 11, wherein:

free ends of the two groove walls are bent towards each other to form two holding sections; and free ends of the two flanges are bent towards each other to form two inclined sections, each of the two flanges being provided on a corresponding groove wall, and each of the two holding sections being configured to abut against a corresponding inclined section.

13. A basket comprising:

a basket body; and at least one sliding structure connected to the basket body, the sliding structure comprising:

a connecting member connected to the basket body;

at least one support member connected to the connecting member, the at least one support member comprising an engaging groove and an accommodating groove spaced from the engaging groove, and one end of the connecting member being engaged in the engaging groove; and a guiding rail connected to the at least one support member and received in the accommodating groove, wherein the connecting member comprises:

a connecting rod connected to the basket body, and at least one bending section engaged in the engaging groove and connected to an end of the connecting rod, an angle being defined between the at least one bending section and the end of the connecting rod;

wherein the engaging groove comprises:

two opposite side walls, and at least one accommodating space, the two opposite side walls being configured to recess outwardly to form the at least one accommodating space, and the at least one bending section being received in the at least one accommodating space; and wherein the sliding structure further comprises an engaging block, the engaging block being received in the engaging groove and abutting against the at least one bending section.

14. The basket of claim 13, wherein:

the at least one bending section comprises two bending sections, the two bending sections being connected to two ends of the connecting rod respectively; and the at least one support member comprises two support members, each of the two bending sections being engaged in one corresponding engaging groove, one end of the guiding rail being received in one of the two accommodating grooves, and the other end of the guiding rail being received in the other one of the two accommodating grooves; and/or the connecting member further comprises at least one abutting section connected to a free end of the at least one bending section, an angle being defined between the at least one abutting section and the at least one bending section, and the at least one abutting section being configured to abut against an outer surface of the engaging groove.

15. The basket of claim 13, wherein:

a bottom wall of the accommodating groove comprises a first opening;

the guiding rail comprises:

a board comprising a second opening, the first opening matching the second opening; and the sliding structure further comprises a fixing member, the fixing member penetrating the first opening and the second opening to connect the guiding rail with the at least one support member.

16. The basket of claim 15, wherein:

the fixing member comprises:

a first fixing end abutting against a surface of the at least one support member, wherein the surface is away from the guiding rail;

a second fixing end opposite to the first fixing end and abutting against a surface of the board away from the connecting member; and a connecting end connecting the first fixing end and the second fixing end, the connecting end being received in the first opening and the second opening; and/or the accommodating groove comprises:

two opposite groove walls, at least one of the two groove walls being provided with a convex rib; and the guiding rail further comprises two opposite flanges, the two flanges being convexly disposed on two side portions of the board respectively, an outer surface of at least one of the two flanges being concavely provided with a guiding groove, and the convex rib being received in the guiding groove.

17. A dish washer comprising a basket, wherein the basket comprises:

a basket body; and at least one sliding structure connected to the basket body, the sliding structure comprising:

a connecting member connected to the basket body;

at least one support member connected to the connecting member, the at least one support member comprising an engaging groove and an accommodating groove spaced from the engaging groove, and one end of the connecting member being engaged in the engaging groove; and a guiding rail connected to the at least one support member and received in the accommodating groove, wherein the connecting member comprises:

a connecting rod connected to the basket body, and at least one bending section engaged in the engaging groove and connected to an end of the connecting rod, an angle being defined between the at least one bending section and the end of the connecting rod;

wherein the engaging groove comprises:

two opposite side walls, and at least one accommodating space, the two opposite side walls being configured to recess outwardly to form the at least one accommodating space, and the at least one bending section being received in the at least one accommodating space; and wherein the sliding structure further comprises an engaging block, the engaging block being received in the engaging groove and abutting against the at least one bending section.

* * * * *